United States Patent [19]

Weber et al.

[11] Patent Number: 4,801,913

[45] Date of Patent: Jan. 31, 1989

[54] FLAT BI-METALLIC STRIP CIRCUIT BREAKER

[75] Inventors: Jacques Weber, Vétraz-Monthoux; Bertrand Torcheux, Ambilly, both of France

[73] Assignee: DAV, Annemasse, France

[21] Appl. No.: 112,088

[22] Filed: Oct. 26, 1987

[30] Foreign Application Priority Data

Oct. 27, 1986 [FR] France ..... 86 14889

[51] Int. Cl.[4] ..... H01H 71/16

[52] U.S. Cl. ..... 337/66; 337/91; 337/68

[58] Field of Search ..... 337/68, 66, 91

[56] References Cited

U.S. PATENT DOCUMENTS 3,311,725 10/1965 Butler et al. .
4,573,031 2/1986 Krasser ..... 337/68
4,682,138 7/1987 Sell ..... 337/68

FOREIGN PATENT DOCUMENTS 2720499 11/1977 Fed. Rep. of Germany .
2640181 3/1978 Fed. Rep. of Germany .
3526785 7/1986 Fed. Rep. of Germany .
1189234 10/1959 France .

*Primary Examiner*—H. Broome
*Attorney, Agent, or Firm*—Stevens, Davis, Miller & Mosher

[57] ABSTRACT

Disclosed is a bi-metallic strip connected to one electrical contact tab and holding a contact which works together with a fixed contact carried by another electrical contact tab. The mobile contact and the connection of the other tab with the bi-metallic actuator are diametrically opposed along a diameter that is inclined with respect to the median plane where the plane passes through the center of the bi-metallic actuator and between the coplanar connecting tabs.

15 Claims, 1 Drawing Sheet

FLAT BI-METALLIC STRIP CIRCUIT BREAKER

BACKGROUND OF THE INVENTION

This invention relates generally to circuit breakers, and more particularly to a flat circuit breaker having a bi-metallic strip which is rounded and which can be used in the automotive industry.

Numerous flat circuit breakers have been used for decades and for a variety of applications. Certain ones, like those described in Patents GB No. 657 434 and 1,542,252 or FR No. 2,531,264, have bi-metallic strips provided with special cut-outs that demarcate at least one, central flexible lamina. Others, like those described in Patents FR No. 1,361,950 2,385,216 and 2,466,846, involve either bi-metallic strips with special cut-outs or a rectangular bi-metallic strip and a mobile contact held by the bi-metallic strip.

In the prior art circuit breakers the mobile part, generally consisting of a pushbutton, is moved between a bi-metallic strip contact and one held by a connecting tab that ensures an electrical continuity with the strip so as to interrupt an electrical feed whenever the strip is deformed as a result of a temperature rise occurring in said bi-metallic strip due to the Joule effect.

The major drawback with these circuit breakers is interposing an element between the fixed contact and the mobile one. Moreover, the need for making a cut-out in the bi-metallic strip in accordance with a special configuration implies not just very special tooling but also acceptance of somewhat-imprecise manufacturing tolerances for the strip on account of the nature of the metals used to make bi-metallic strips. Lastly, circuit breakers are not particularly flat because of superimposing of at least three elements, so such circuit breakers are not easily usable on automobile vehicles when there is so little room available where electrical connections are made.

SUMMARY OF THE INVENTION

This invention remedies the aforementioned inconvenience in providing an extremely reliable, flat circuit breaker whose bulk is reduced t the minimum.

One object of this invention is a circuit breaker of the type that comprises a housing which accommodates a quick-acting, bi-metallic dome-shaped actuator, holding a mobile contact, an initial orifice having been made at the center of said dome; coplanar connecting tabs associated with the bi-metallic actuator in question, one of the aforementioned tabs holding a fixed contact that works together with the mobile contact, and it is characterized in that the mobile contact and the tie-in with the other tab connecting with the bi-metallic actuator are diametrically opposite along a diameter which is inclined with respect to the median plane passing through the center of said bi-metallic actuator and between the coplanar connecting tabs.

By shifting sideways the fixed contact held by a connecting tab, as well as the tie-in between the other tab and the bi-metallic actuator, use can be made of the space under the actuator for possibly accommodating another circuit-breaker control member without any effect on the overall bulk of that circuit breaker.

In accordance with another feature of the invention, the bi-metallic actuator comprises a central, cylindrical orifice whose dimensions determine the calibration of the circuit breaker, and two other small orifices, one of which works together with a dowel mounted on a control pushbutton, keeping the bi-metallic actuator in the separated, electrically-open position of its contact, with respect to the fixed contact, so long as said actuator is not reset; whereas, upon assembly, the other one serves for proper positioning of that actuator in the housing with respect to the connecting tabs.

BRIEF DESCRIPTION OF DRAWINGS

Other advantages and characteristics will be better appreciated upon reading the description of two preferred modes of embodying the invention, indicated as non-limiting examples, plus attached drawings in which.

DETAILED DESCRIPTION OF PREFERRED EMBODIMENTS

Figure 1:
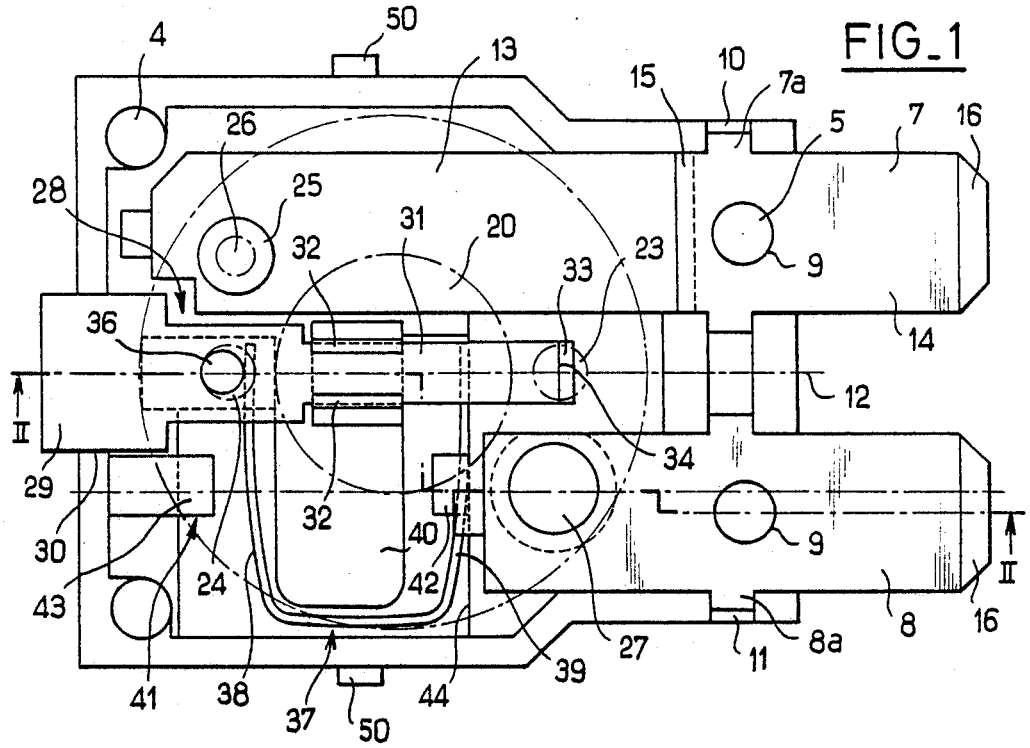
FIG. 1 is a top view of the circuit breaker in accordance with this invention with the cover portion of the housing removed.
Figure 2:
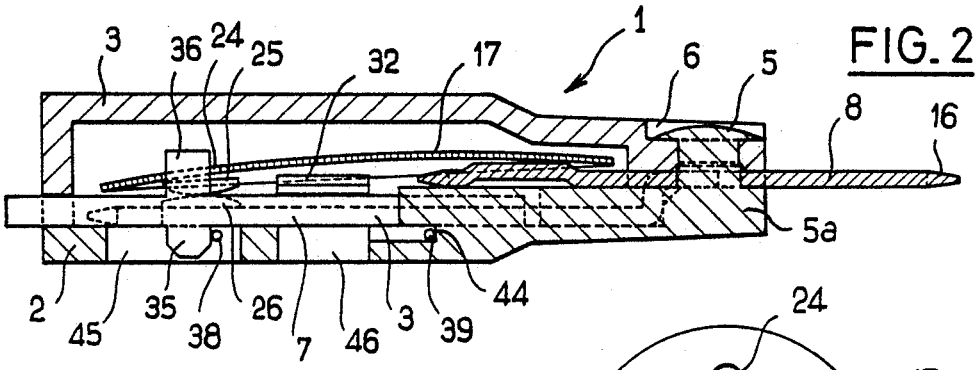
FIG. 2 is a cross sectional view along II—II in FIG. 1.

The circuit breaker in conformity with the invention, and represented in FIGS. 1 and 2, includes a housing 1 composed of two portions 2 and 3, one of them (2, for example) serving to accommodate the various elements of the circuit breaker, the other one 3 utilized as a closing cover. Linking of the two portions 2 and 3 is ensured by four dowels 4 and 5, cast integrally with portion 2, that fit in the corresponding orifices made in the closing cover 3, though just one of them is represented in FIG. 2.

Each of the two, flat, coplanar connecting tabs 7 and 8 involves an orifice 9 into which is force-fitted a dowel 5 which has, for that very purpose, a chamfered end that allows for it to be more easily inserted in the corresponding orifice 9 and a broadened base 5*a* to prevent movement of the connecting tab along the dowel. Lateral projections 7*a* and 8*a*, lodged in grooves 10 and 11 provided in the base portion 2, keep said tabs from moving sideways or in the direction of a median plane for the circuit breaker, as indicated by the dashes 12, and the connecting tabs 7 and 8 are arranged symmetrically in relationship to said median plane.

Tab 7 is longer than tab 8 and has a configuration that follows along two parallel planes, situated one above the other, such as to conform to the shape of the housing 1 which is designed to have the least bulk possible. The tab portions 13 and 14, located in different planes, are connected by an inclined portion 15. The free ends 16 of the tabs 7 and 8 are chamfered so as to permit easy insertion in the receiving clips which are not represented.

Figure 3:
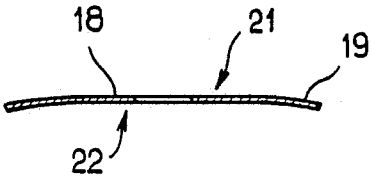
FIG. 3 is an elevation view of the bi-metallic actuator represented in FIG. 1.

A bi-metallic actuator 17 (FIGS. 3 and 4) consists of a rounded disk so as to constitute what is conventionally called a quick-acting bi-metallic strip. Such a strip 17 is made from a disk 17 mm in diameter, for example which has been deformed along two spheres of different radii in order to get a central portion 18 with an R radius bounded by a crown 19 having an $R_2$ radius. A cylindrical opening 20 is made in the central portion 18, and the diameter of that opening (which varies from 0 to 10 mm) permits calibrating the circuit breaker as a function of the operation amperages under which the breaker must function. Obviously, either the diameter of the central opening or the thickness of the bi-metallic strip can be varied to further improve the circuit-breaker operating conditions, or even varying simultaneously both of the parameters above.

The bi-metallic strip 17 is pre-calibrated for temperature and must withstand as much as 140° C. Among materials that can be used to make the bi-metallic strip 17, for the inner face 22 there is preference for using a material with zero coefficient of expansion as, for instance, INVAR which is composed of 64% iron, 36% nickel and 0.25-to-0.30% chromium. The outer face 21 is of an alloy with a high, positive coefficient of expansion, having an iron-nickel-maganese base or else an iron-nickel-chromium base. Possibly a very thin layer of nickel or copper is put between the inner and outer faces to adjust the resistivity of the bi-metallic strip 17.

Following along the median plane 12, the bi-metallic strip 17, shown by the dotted line in FIG. 1, involves two small-diameter orifices 23 and 24 which can be made in the central portion of 18, in the crown 19 or where those portions are joined, as a function of the dimensions of the aforesaid portions 18 and 19. The orifice 23 serves for properly positioning the bi-metallic strip 17 upon its being mounted in portion 2 by means of a suitable assembling tool, which is not represented. A mobile contact 25 is found on the inner face 22 of the bi-metallic strip 17, and it cooperates with a fixed contact 26 provided opposite it on the tab 7. Tab 8 is joined to the bi-metallic strip 17, for example by a spot weld 27. When the mobile contact 25 and fixed contact 26 are up against each other, the electrical continuity between the tabs 7 and 8 is ensured by said contacts 25 and 26, the bi-metallic strip 27 and the spot weld 27. The fixed contact 26 and the spot weld 27 are aligned along a diameter of the bi-metallic strip 17 which is inclined, with regard to the median plane 12, by an angle of 36° , for example.

resetting pushbutton 28 is mounted in the base portion 2 of the housing. The broadened head 29 is guided in a notch 30 made in said portion 2, whereas the push rod 31, which is flat, is guided by two side flanges 32 provided above a groove 33 in which the push rod moves. Accordingly, the push rod 31 can move only by sliding in its guiding groove. Any disengagement perpendicular to the direction of slide is prevented by the flanges 32. So as to improve insertion on mounting the push rod 31 in the groove 33, the end 34 of the push rod 31 is also confirmed. Two dowels 35 and 36 are each mounted symmetrically on a face of the push rod 31. The dowel 36 can be inserted in the bi-metallic strip orifice 24 in order to latch the pushbutton in the normal position. The dowel 35 serves as support for a bow 38 of a spring 37 shaped like a hairpin. The spring 37 is laid flat under the bi-metallic strip 17 around a slight recess 40 and between two small flanges 41 and 42, provided above small openings 43 made in the base portion 2, while the spring bow 39 is passed under the flange 42 and rests against a small vertical wall 44. The dowel 35 can be moved in a rectangular opening 46 made between the side flanges 32. The various openings 43, 45 and 46, thus made in the base 2 wall, allow for venting the inside of the housing, which prevents needless raising of the temperature there upon arcing as contacts are broken.

Lastly, the housing comprises separable clamps 50 that connect the housing 1 between them so as to permit mass production in the shape of a chain that can be band coiled.

Operation of the circuit breaker in accordance with the invention is as follows: At rest the contacts 25 and 26 are up against each other, the pushbutton 28 is latched in the depressed or engaged position by the dowel 36 in the orifice 24 of the bi-metallic strip 17.

When, on passing of an electric current, the temperature of the bi-metallic strip 17 reaches a value predetermined as a function of the circuit-breaker calibration, the bi-metallic strip 17 deforms sharply in the direction opposite bulging of the central dome, thus severing the electrical connection between the contacts 25 and 26. Movement of the bi-metallic strip 17 has the effect of releasing the previously latched dowel 35 and the pushbutton 28 is moved toward a disengaged position under the action of the spring 37. When the bi-metallic strip cools off, the contacts 25 and 26 remain open with the bi-metallic strip prevented from returning to a contact position by contacting the top of the dowel 35. Manually resetting the circuit breaker is accomplished by depressing the pushbutton 28 in order to bring the dowel 35 into conjunction with the bi-metallic strip orifice 24 whereupon the bi-metallic strip can then flex to the contact position. As can be ascertained, the pushbutton 28 does not move at all between the contacts 25 and 26, so it never touches either of them. Consequently, the pushbutton cannot be deformed or worn out by sparks from breaking of the contacts 25 and 26. Furthermore, those contacts are, themselves, protected and cannot be contaminated by material that might ge between them.

Figure 4:
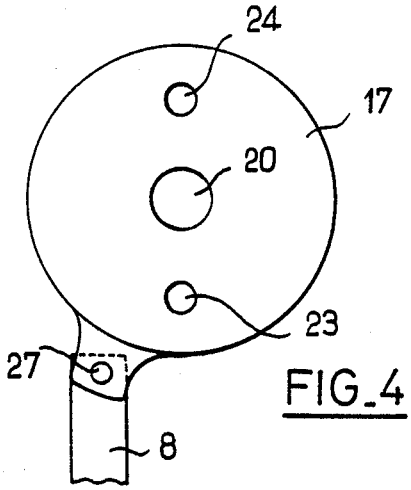
FIG. 4 is a diagrammatic top view of the bi-metallic actuator linked to a connecting tab in accordance with a variant of the invention.

The variant represented schematically in FIG. 4 shows that the connection between the short tab 8 and the bi-metallic strip 17 can be effected by any appropriate means, for example on an appendage of the strip 17, so as to improve, if need be, the current amperage in said bi-metallic strip 17.

Of course, the invention is not limited to the embodiments described and represented above, since it is adaptable to a number of variants known to those of ordinary skill in the art in view of the specification, depending on the applications conceived, and still without exceeding the scope of the invention. Therefore, the invention is limited only by the scope of the claims appended hereto.

What is claimed:

1. A flat circuit breaker comprising:

a housing including a groove;

a quick-acting bi-metallic actuator, said actuator having at least one spherical portion;

a mobile contact mounted on said bi-metallic actuator;

at least two connecting tabs, each of said tabs being fixed and coplanar, one of said at least two tabs connected to said bi-metallic actuator at a fixed connection, the other of said at least two tabs including said fixed contact, said fixed contact and said mobile contact cooperating to make and break an electric circuit between said at least two tabs, said fixed connection and said mobile contact being diametrically opposed along a diameter of said bi-metallic actuator, said diameter inclined with respect to a median plane of said circuit breaker passing through the center of said bi-metallic actuator and between said at least two coplanar connecting tabs;

pushbutton means received in said groove movable between engaged and disengaged positions, for resetting the bi-metallic actuator; and spring means for moving the pushbutton towards said disengaged position, said pushbutton including means for guiding said pushbutton during movement between said engaged and disengaged positions and means for latching said pushbutton in said engaged position.

2. The circuit breaker in accordance with claim 1, wherein said bi-metallic strip includes at least one orifice therein for adjustment of said strip and its positioning upon assembly.

3. The circuit breaker in accordance with claim 2, wherein said latching means comprises another orifice on said actuator and a dowel on said pushbutton, said orifices are diametrically opposed and located in a median plane that passes between said at least two connecting tabs.

4. The circuit breaker in accordance with one of claims 1–3, wherein said bi-metallic actuator is comprised of a disk made up of two, different-radii spheres, said actuator having a central position of a larger radius bounded by a crown of a smaller radius.

5. The circuit breaker in accordance with claim 4, wherein said fixed connection and said mobile contact are located on said crown.

6. The flat circuit breaker in accordance with claim 3, wherein said bi-metallic actuator includes a third orifice centrally arranged between the one and another orifices, said third orifice having a diameter greater than the diameters of said one and another orifices.

7. The flat circuit breaker in accordance with claim 1, wherein said pushbutton includes a broadened head, said guiding means includes a longitudinal aperture in said housing, and said pushbutton including a projection extending into said aperture.

8. The circuit breaker in accordance with claims 1 or 7, wherein said housing includes means for retaining said pushbutton in said groove.

9. The circuit breaker in accordance with claim 1, wherein said housing includes means for mounting said spring means.

10. The circuit breaker in accordance with claim 1, each of said at least two connecting tabs include one orifice, and said housing includes corresponding positioning dowels for each connecting tab orifice.

11. The circuit breaker in accordance with claim 1, wherein said bi-metallic actuator is comprised of a zero coefficient of expansion material made of an iron-nickel-chromium base, and a positive, high coefficient of expansion material.

12. The circuit breaker in accordance with claim 11, wherein said actuator further includes a layer of conductive material between the materials.

13. The circuit breaker in accordance with claim 1, wherein said at least two connecting tabs each include lateral projections, said housing includes grooves corresponding to said lateral projections, said lateral projections and corresponding grooves comprising a means for locating said connecting tabs.

14. The circuit breaker in accordance with either claim 1 or 13, wherein said housing includes separable side connections.

15. The circuit breaker in accordance with one of claims 1 or 2, wherein said bi-metallic strip is pre-calibrated to actuate a temperature of 140° C.

* * * * *